US005154260A

United States Patent [19]

Patel

[11] Patent Number: 5,154,260

[45] Date of Patent: Oct. 13, 1992

[54] METHOD AND SYSTEM FOR AUTOMATED PROCESSING OF ARTICLES

[75] Inventor: Ramesh U. Patel, Cambridge, Ohio

[73] Assignee: NCR Corporation, Dayton, Ohio

[21] Appl. No.: 681,839

[22] Filed: Apr. 8, 1991

[51] Int. Cl.[5] ..... E04H 3/04

[52] U.S. Cl. ..... 186/55; 186/69

[58] Field of Search ..... 186/55, 56, 69

[56] References Cited

U.S. PATENT DOCUMENTS

| | | | |
|---|---|---|---|
| 1,592,931 | 7/1926 | Fritsche | 186/69 |
| 2,355,708 | 8/1944 | Delucchi et al. | 186/69 |
| 2,416,870 | 3/1947 | Farmer | 186/55 |
| 2,603,315 | 7/1952 | Lee | 186/69 |
| 2,628,691 | 2/1953 | Barrett | 186/69 |
| 2,661,682 | 12/1953 | Saunders | 186/55 X |
| 2,888,197 | 5/1959 | Winn | 186/55 X |
| 2,980,211 | 4/1961 | Richter | 186/69 |
| 3,023,851 | 3/1962 | Stiller | 186/1 |
| 3,379,321 | 4/1968 | Weir | 214/16.4 |
| 3,532,184 | 10/1970 | Blake | 186/1 |
| 3,741,345 | 6/1973 | Saridis | 186/1 R |
| 3,920,100 | 11/1975 | Dunphy | 186/56 X |
| 4,661,908 | 4/1987 | Hamano et al. | 364/405 |

FOREIGN PATENT DOCUMENTS

| | | | |
|---|---|---|---|
| 53-17238 | 2/1978 | Japan | 186/69 |

*Primary Examiner*—F. J. Bartuska
*Assistant Examiner*—Scott L. Lowe
*Attorney, Agent, or Firm*—Albert L. Sessler, Jr.

[57] ABSTRACT

A system and method for automated processing of articles include a plurality of storage units separated by aisles through which customers can pass to select articles for processing. The selected articles are identified by tags applied thereto from identification record members provided to the customers, and are placed on conveyors located adjacent to the storage units for transportation to a checkout station where they are collected, their prices are totalled, and payment is made. The articles are then further transported to a plurality of bagger stations where they are bagged and released to the customer after verification that payment has been made.

18 Claims, 6 Drawing Sheets

UNIQUE ID
*(BEFORE PURCHASE)*

UNIQUE ID
*(AFTER PURCHASE OF 5 ITEMS)*

UNIQUE ID

*(BEFORE PURCHASE)*

UNIQUE ID

*(AFTER PURCHASE OF 5 ITEMS)*

METHOD AND SYSTEM FOR AUTOMATED PROCESSING OF ARTICLES

BACKGROUND OF THE INVENTION

This invention relates to a method and system for automated processing of articles and more particularly relates to an automated checkout system for efficiently handling the selection and purchase of items in a retail establishment such as a supermarket.

For many reasons, including those of labor costs and customer convenience, the rapid processing of articles which are selected from a storage location for delivery to a remote point, has become increasingly important. One example of an application in which such article processing is important is in a supermarket or other retail establishment. Supermarkets most commonly employ customer-operated grocery carts in the transportation of selected grocery and other items from stocked shelves to a checkout station where the price of each article is determined, the total bill is computed, and payment is made by the customer. Some of the disadvantages of such a system include congestion from a large number of carts being operated by customers in narrow aisles between food displays, costs of purchasing and maintaining the carts and waiting in line by customers at checkout stations. It would therefore be advantageous to have an article processing system, such as could be used in a supermarket or other retail establishment, which would largely eliminate the need for grocery carts and which would facilitate the speedy and efficient selection and processing of articles.

SUMMARY OF THE INVENTION

In the present invention, a method and system for automated processing of articles, such as in a supermarket or other retail establishment, are provided.

In accordance with a first embodiment of the invention, an automated process for processing articles, said process employing storage means for holding a plurality of articles to be processed, user identification means including an identification section and a plurality of removable labels, sensible indicia being located beneath each removable label, a processing station including scanning means for processing selected articles, a plurality of collecting stations, scanning means associated with each collecting station for scanning labels placed on articles to be processed and conveyor means for transporting the selected articles, comprises the following steps: (a) providing each user with said user identification means; (b) selecting articles to be processed by a user; (c) placing individual labels from the user identification means by a user on articles selected for processing; (d) placing selected labelled articles on the conveyor means for transportation to the processing station; (e) sensing the number of sensible indicia on the user identification means at the processing station to determine how many labels have been removed therefrom and thereby ascertain the total number of articles selected and labelled; (f) scanning all transported articles at the processing station; (g) verifying the validity of labels on all labelled items at the processing station; (h) comparing the number ascertained from the user identification section with the number of labelled articles scanned to verify that all selected articles have been scanned at the processing station; and (i) collecting all of the selected articles at a predetermined one of said collecting stations by sensing the labels affixed to said selected articles.

In accordance with a second embodiment of the invention, an automated check-out process for enabling selected articles in an establishment to be purchased, said process employing storage means for holding a plurality of articles available for purchase, customer identification means including an identification section and an area containing a plurality of adhesive labels, each label containing identical identification indicia, each label being removable from the record member with the adhesive on the label enabling it to be affixed to a selected article which the customer wishes to purchase, a check-out station including scanning means, a plurality of bagging stations, scanning means associated with each bagging station for scanning labels placed on articles to be purchased, and conveyor means for transporting the selected articles comprises: (a) providing each customer with said customer identification means; (b) selecting articles to be purchased by a customer; (c) placing individual labels from said area of the customer identification means by a customer on articles selected for purchase; (d) placing selected labelled articles on the conveyor means for transportation to the check-out station; (e) scanning all transported articles at the checkout station; (f) verifying the validity of labels on all labelled articles at the checkout station; (g) returning any improperly labelled articles to the storage means; (h) determining that all selected articles have been scanned at the checkout station by scanning markings on the record member which are revealed when a label is removed, thereby ascertaining how many labels have been removed from the record member and thus how many articles have been selected by that customer; (i) making payment by the customer at the checkout station for all selected articles scanned; (j) collecting all of the selected articles at a predetermined one of the bagging stations by sensing the labels affixed to said selected articles; and (k) bagging the collected articles and released the bagged articles to the customer.

In accordance with a third embodiment of the invention, an automated article processing system comprises: a plurality of storage devices for holding a plurality of articles to be processed; a checkout station including means for sensing indicia on articles presented thereto, and means for generating data concerning all of the articles of a certain category presented thereto; a plurality of collection stations including means for sensing indicia on articles presented thereto and collecting all of the articles of a certain category; conveyor means for transporting selected indicia-bearing articles from the storage devices to the checkout station and from the checkout station to the collection stations; and an identification device for use in said system, said device comprising a base element having predetermined indicia thereon, having a plurality of labels attached thereto and removable therefrom for affixing to selected articles, said base element having a marking beneath each label attached thereto, said marking being sensible when the label associated therewith is removed, said labels bearing at least a portion of the predetermined indicia on the base element and also having different indicia to distinguish one label from another.

It is accordingly an object of the present invention to provide an improved method for automated processing of articles.

Another object is to provide an improved system for automated processing of articles.

Another object is to provide an improved automated check-out process for enabling selected articles in an establishment to be purchased.

With these and other objects, which become apparent from the following description, in view, the invention includes certain novel features of construction and combinations of parts, preferred forms or embodiments of which are hereinafter described with reference to the drawings which accompany and form a part of this specification.

DETAILED DESCRIPTION

Figure 1:
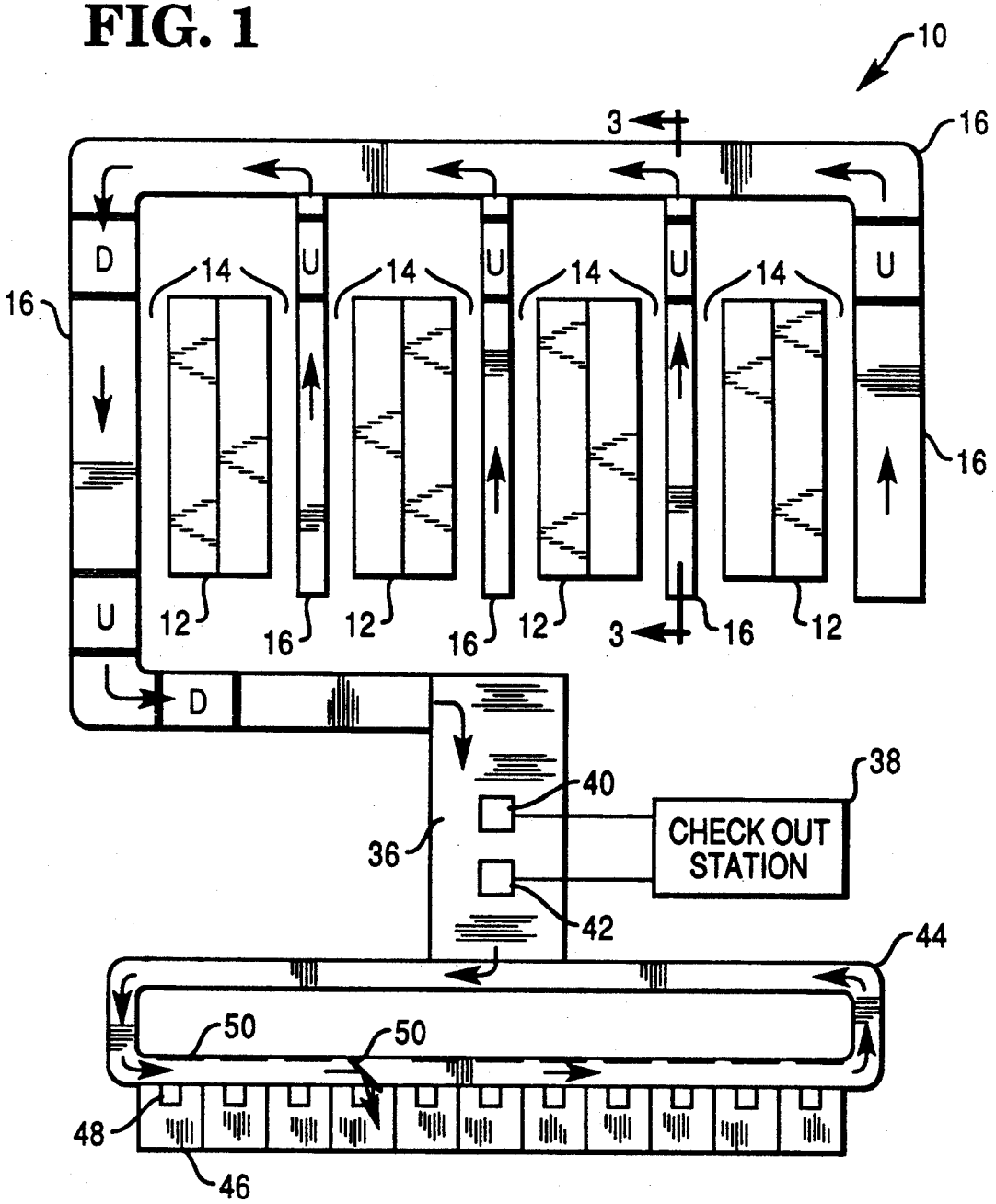
FIG. 1 is a diagrammatic plan view of the automated checkout system of the present invention.
Figure 3:
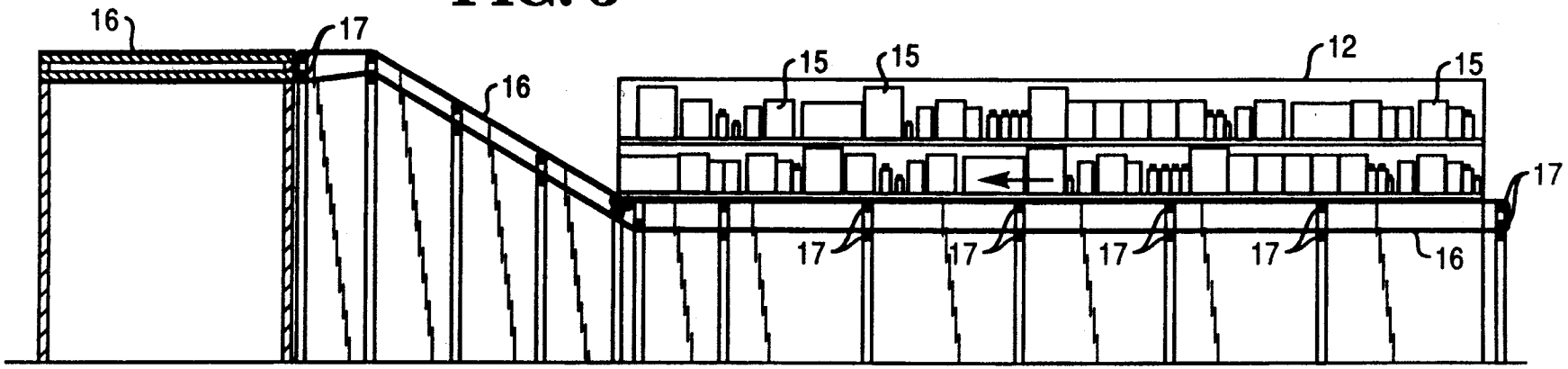
FIG. 3 is a cross-sectional view, taken along 3—3 of FIG. 1.

Referring now to FIG. 1, shown there is a layout of a facility 10 in which processing of articles takes place. Such a facility may, for example, be a supermarket in which a plurality of storage facilities 12, such as shelves, stocked with food and other articles, are separated by aisles 14. Extending through the aisles 14 and surrounding the area containing the storage shelves are an interconnected plurality of conveyors, represented generally by reference character 16. It will be noted in FIG. 3 that the various conveyors 16 are partially located in an elevated position to enable customers and employees to pass safely underneath. The conveyors may be of the endless loop type, supported on and driven by rollers 17 spaced in appropriate locations. The conveyors 16 drop in height in their positions between adjacent storage shelves 12, so that articles which are selected by customers can conveniently be placed on the conveyors. The letters "D" and "U" on the conveyors 16 in FIG. 1 represent changes in elevation of the conveyors 16 "down" and "up". Typically the conveyors 16 will be at a height of 3 to 4 feet from the floor in their locations in the aisles between adjacent storage shelves. These conveyors may be provided with surfaces having a high coefficient of friction, or may be provided with spaced cleats or other projections on their surfaces, in order to enable the articles placed thereon to remain in place during changes in conveyor height, when the conveyor moves up or down an incline.

Use of the conveyor system by customers involves selection of articles 15 by customers from the shelves 12, placing identifying indicia on the articles selected, and,-placing the marked articles on one of the conveyors 16.

Figure 4:
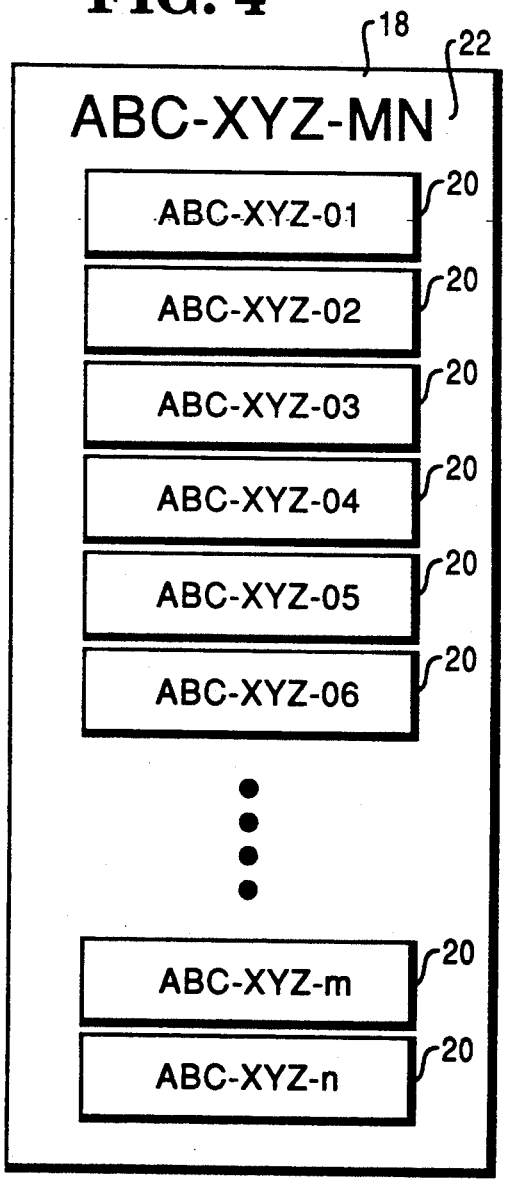
FIG. 4 is an elevation view of a first embodiment of an identification record member employed in the present invention, showing a plurality of labels with alphanumeric data attached thereto.
Figure 5:
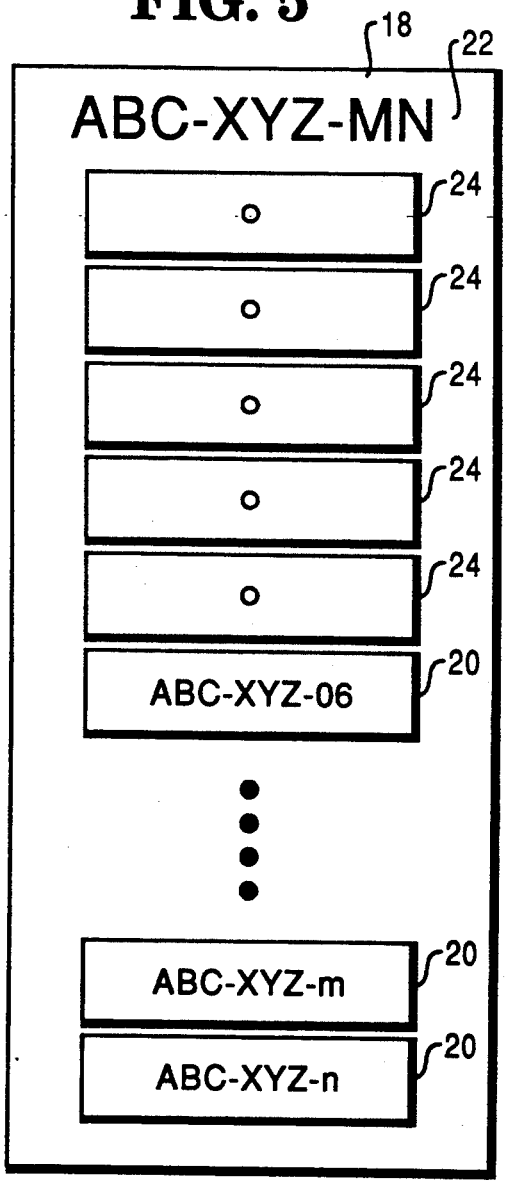
FIG. 5 is an elevation view of the identification record member, similar to FIG. 4 but with some of the labels removed therefrom.

Various means may be employed by a customer to mark or identify the goods selected. One such means is shown in FIGS. 4 and 5 and comprises an identification record member 18 on which are removably placed a plurality of tags 20. Each tag 20 is secured to the record member 18 by a suitable adhesive which permits it to be removed from the record member and applied to a selected article which the customer desires to purchase.

As shown in FIG. 4, the identification record member 18 contains an identification section 22 in addition to the removable tags. The information contained in the identification section is identical to that appearing on each of the tags 20. As shown in FIG. 4, when a tag 20 is removed from the record member 18, a blank portion 24 is revealed, which portion may contain indicia such as the zero shown there to enable a device which scans the record member to determine that the tag has been removed. Thus if five tags 20 have been removed from the record member 18, a scanner can count the number of zeros or other indicia revealed and obtain a count on how many articles the customer has selected or purchase.

Figure 6:
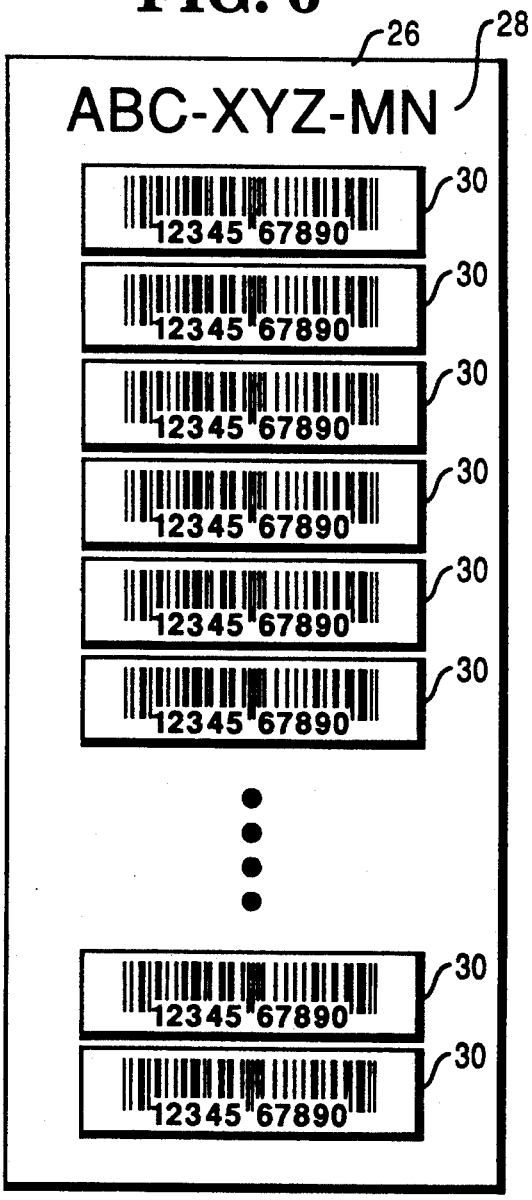
FIG. 6 is a view similar to FIG. 4, showing a second embodiment of an identification record member, in which the plurality of labels have bar code data thereon.
Figure 7:
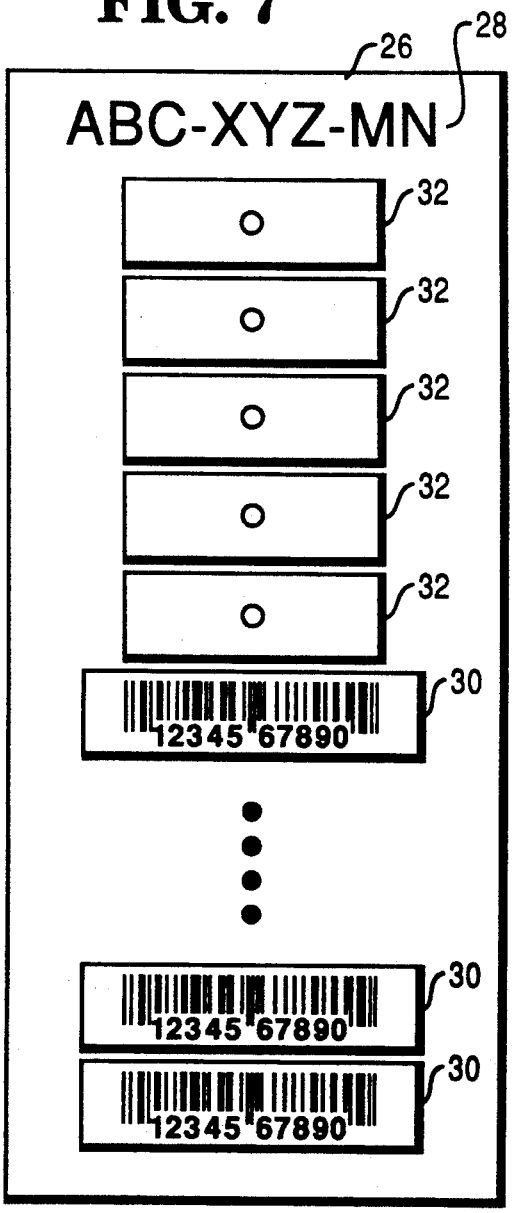
FIG. 7 is an elevation view of the identification record member, similar to FIG. 6, but with some of the labels removed therefrom.

It will be noted that in FIGS. 4 and 5, the indicia appearing on the record member and on the tag is in the form of alpha-numeric data, which can be sensed by a state-of-the-art optical scanner. A second embodiment of the identification record member is shown in FIGS. 6 and 7, in which a record member 26 contains alphanumeric identification information 28, and in which the tags 30 contain similar data in the form of bar code indicia. As shown in FIG. 6, removal of a tag 30 for affixation to an article to be processed exposes an area 32 containing indicia (here shown in the form of zero) which can be sensed to determine how many tags have been removed from the record member 26, and thus how many articles have been selected by the customer for purchase. Other embodiments of the identification record member could be employed, if so desired. For example a record member could be employed in which all information contained thereon, both in the identification section and on the tags, is in the form of a bar code.

The various conveyors 16 are designed to feed all articles selected by customers and placed on the conveyors to a central conveyor 36. This conveyor carries the selected articles to and past a checkout station 38 which includes data processing equipment, a scanner 40 and a display 42. Typically the checkout station 38 will have a human operator who can control the operation of the conveyor 36 to cause articles to be scanned by the scanner 40 as they are fed from the conveyor 16 to the conveyor 36. A customer who has completed shopping can present an identification record member 18 or 26 to the checkout operator, who will process said record member to enter into a memory the customer identification and the number of articles selected, based upon the number of exposed areas, or blank portions 24 on the record member. The operator will scan each item as it comes through the checkout station and will be able to collect a total of the articles selected by a given customer. The operator will know when the total is complete by comparing the number of articles bearing that identification which have been sensed with the number of blank portions on the record member. The operator can then determine the total amount due for the articles, by scanning the customary UPC (universal product code) information on the articles.

The customer will make payment to the operator of the checkout station for the amount due, and a suitable record will be made on the identification record member to show that payment has been made.

From the central conveyor 36, after scanning and checkout, the articles proceed to a further conveyor 44 which is associated with a series of bagger stations 46, each having an associated scanner 48 and an arm 50. Each bagger station 46 is assigned to the identification number of a particular customer. Each scanner 48 is capable of scanning the indicia on the tag 20 affixed to each article to determine whether or not it matches the identification number assigned to that station. If so, the arm 50 is caused to move across the path of the conveyor 44 to deflect movement of the article from the conveyor 44 into the bagger station 46. The arm 50 then returns to its normal non-blocking position to allow articles which are scanned and found not to contain that identification number to pass through that area unimpeded until the next article bearing a tag 20 having that identification number reaches the area, at which time the arm 50 is activated again to direct another article into the bagger station 46. It will be noted that the conveyor 44 describes a continuous path, so that if an article bearing a particular identification number is not apprehended on its first pass past the line of bagger stations 46, it will be returned for another pass.

Figure 2:
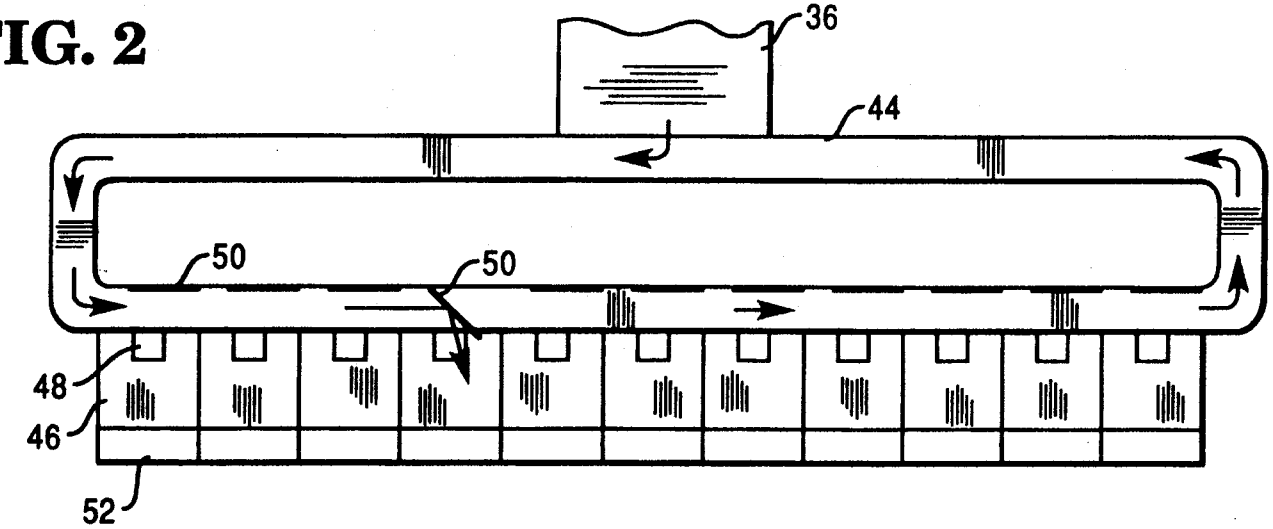
FIG. 2 is a fragmentary plan view, of another embodiment, showing the bagger stations in greater detail, with a security device for restricting access to each of the stations.

When all of the articles bearing a particular identification number have been collected at the appropriate bagger station 46, the customer to whom the selected articles belong may claim them by presenting his or her endorsed identification record member 18 to the bagger station. Each bagger station may have a human operator in attendance, who will collect the identification record member 18 from the customer and give the customer the collected articles. It is quite likely that a single operator would be able to service several of the bagger stations 46, thus minimizing the need for employees. Alternatively, as shown in FIG. 2, bagger station 46 may be provided with a security device 52 so that the collected articles are retained within the bagger station 46 until a properly endorsed identification record member 18 having an identification number corresponding to that assigned to the bagger station is presented to the security device, causing the contents of the bagger station 46 to be released to the customer holding the proper identification record member 18, thus providing a self-service arrangement, eliminating the need for any employees to service the bagger station 46.

Figure 8A:
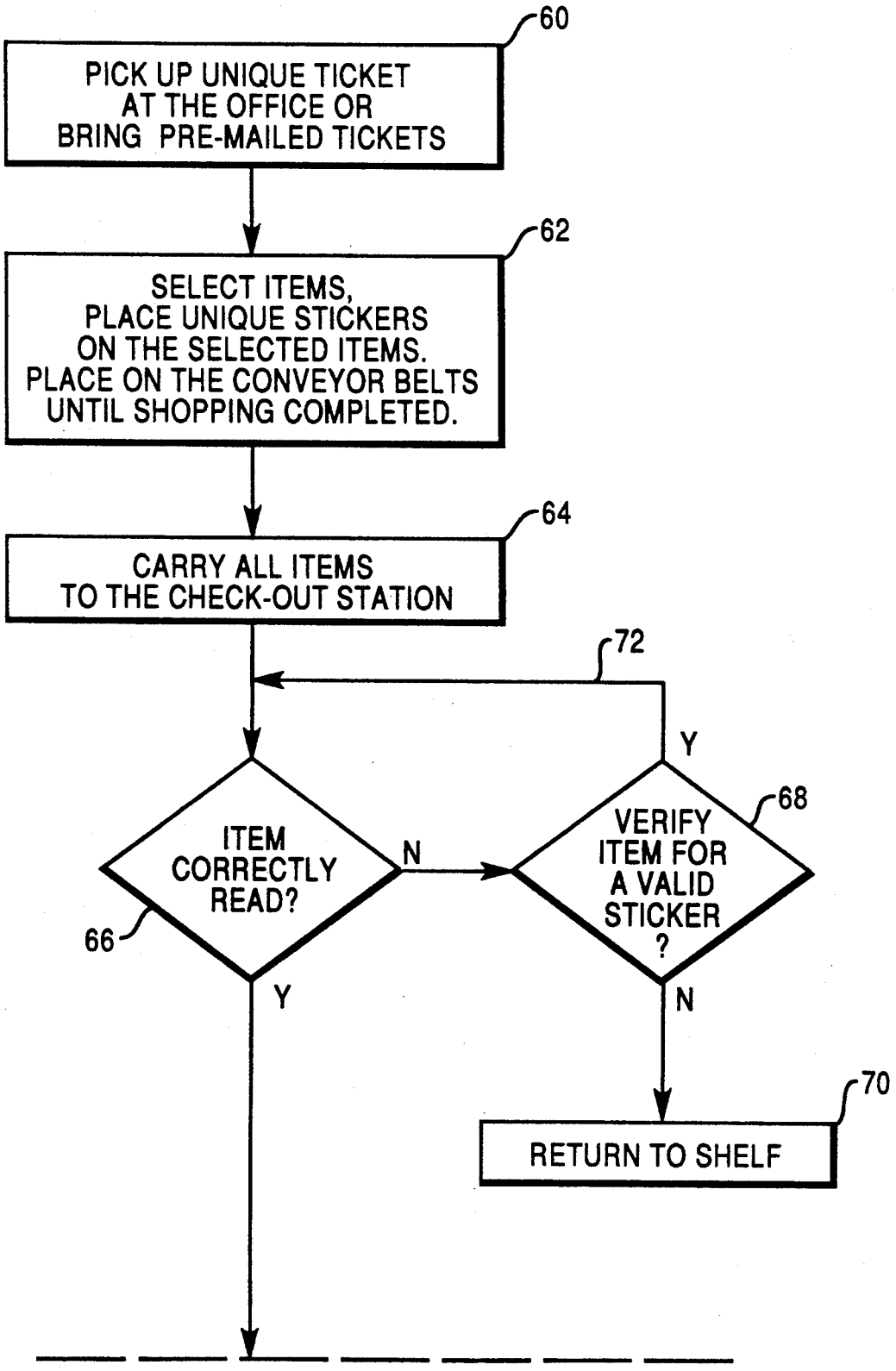
FIG. 8A and 8B, taken together, constitute a flow diagram of the method for automated processing of articles.
Figure 8B:
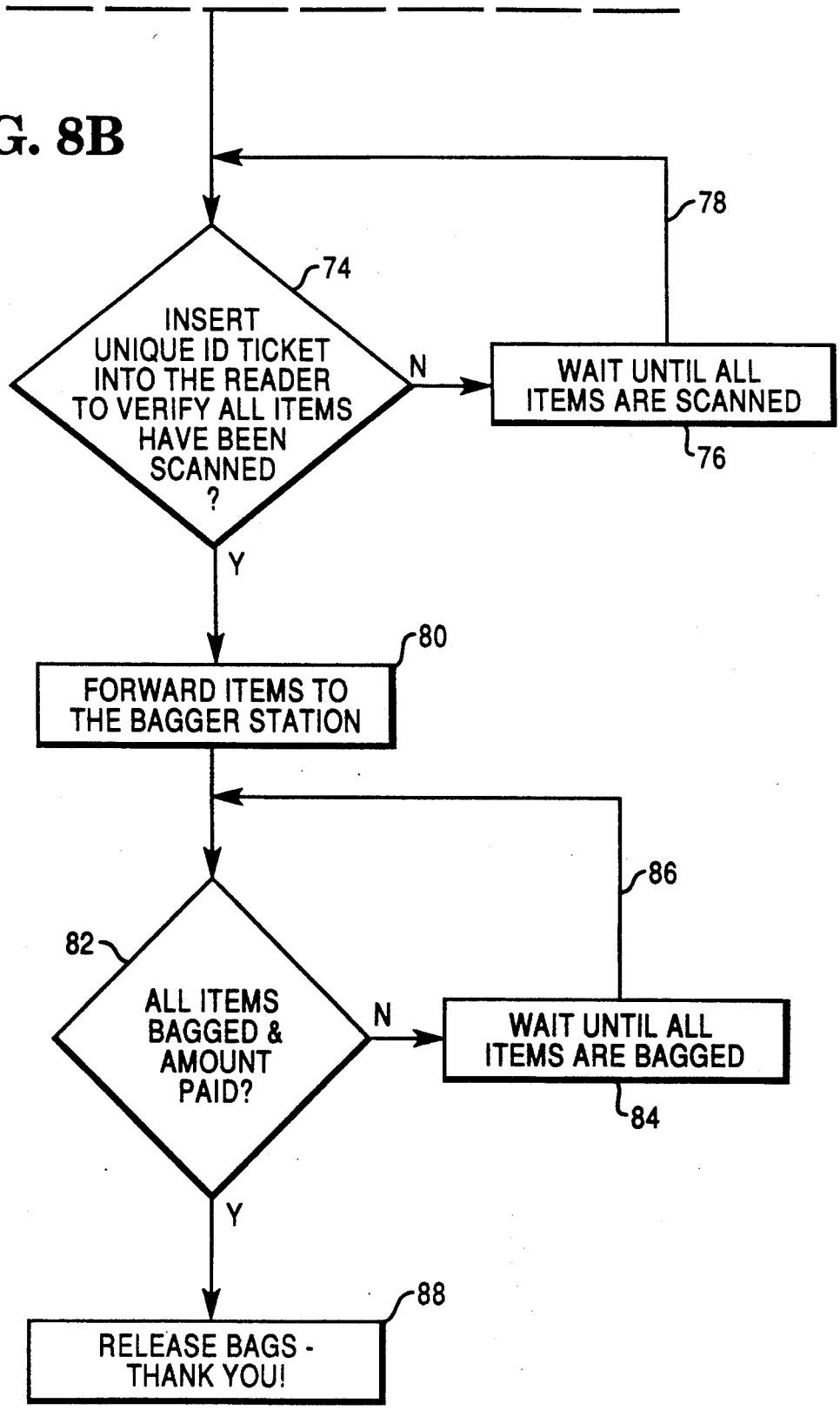

FIGS. 8A and 8B, taken together, show the process which is employed in using the automated article processing system described above. As indicated in block 60, a customer first obtains an identification record member or ticket 18 or 26 at the office of the establishment using the system of the present invention, or alternatively, the customer obtains the record member or ticket by some other means, such as through the mail from the establishment. The customer then proceeds, in the establishment, such as a supermarket, to select articles 15 from the shelves 12, place on the articles the tags 20 or 32, and place the tagged articles on the conveyor 16, as represented in block 62. This procedure is continued until all of the articles 15 desired by the customer have been selected, tagged, and put on the conveyor.

The conveyors 16 and 36 then carry the selected articles 15 to the checkout station 38, as represented in block 64. As has been described above, the tags on the articles are scanned by the scanner 40. A determination is made at the station 38 as to whether the item has been correctly read (block 66) and, if not, the article is examined for presence of a valid tag (block 68). If a valid tag is not present, the article is returned to the storage shelf 12, as represented in block 70. If a valid tag is present, the process returns via path 72 to block 66 for another scanning.

If the item is correctly read, the process continues to block 74 (FIG. 8B), in which the identification record member 18 or 26 is inserted into a reader at the checkout station 38, in order to verify that all items have been scanned, as determined by the number of tags 20 or 30 which have been removed from the record member 18 or 26. At this point, the process loops through a "wait" block 76 and the path 78 until all of the items have been scanned. Payment for the articles purchased is customarily made at this time.

When this has been accomplished, the items are forwarded (block 80) via conveyors 36 and 44 to the bagger stations 46. A determination is then made, as represented by block 82, as to whether all items have been bagged, and the amount due for the articles has been paid. At this point, the process loops through a "wait" block 84 and the path 86 until all of the purchased items are bagged. When all items have been bagged and payment has been verified, the bagged articles are released, as represented by block 88, and the process is completed.

Advantages of the checkout system of the present invention include reduction in the amount of equipment needed at the various stations, a saving in shopping time because of continuous checkout, reduction in number of employees needed, no requirement for shopping carts, better inventory control because of tracking of articles through the store, and facilitation of stocking of articles through use of the conveyor system.

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

What is claimed is:

1. An automated process for processing articles, said process employing storage means for holding a plurality of articles to be processed, user identification means including an identification section and a plurality of removable labels, sensible indicia being located beneath each removable label, a processing station including scanning means for processing selected articles, a plurality of collecting stations, scanning means associated with each collecting station for scanning labels placed on articles to be processed and conveyor means for transporting the selected articles, comprising the following steps:

(a) providing each user with said user identification means;

(b) selecting articles to be processed by a user;

(c) placing individual labels from the user identification means by a user on articles selected for processing;

(d) placing selected labelled articles on the conveyor means for transportation to the processing station;

(e) sensing the number of sensible indicia on the user identification means at the processing station to determine how many labels have been removed therefrom and thereby ascertain the total number of articles selected and labelled;

(f) scanning all transported articles at the processing station;

(g) verifying the validity of labels on all labelled items at the processing station;

(h) comparing the number ascertained from the user identification section with the number of labelled articles scanned to verify that all selected articles have been scanned at the processing station; and (i) collecting all of the selected articles at a predetermined one of the collecting stations by sensing the labels affixed to said selected articles.

2. The automated process of claim 1, also including the steps of determining the amount due for the selected articles at the processing station; and obtaining payment for said articles.

3. The automated process of claim 1, in which the identification indicia on each label comprise numerical indicia, and the scanning operation of step (f) comprises scanning said numerical indicia.

4. The automated process of claim 1, in which the identification indicia on each label comprise bar code indicia, and the scanning operation of step (f) comprises scanning said bar code indicia.

5. The automated process of claim 1, in which the identification section of the user identification means includes user identification indicia corresponding to the user identification on the labels, and the sensing operation of step (e) comprises sensing such user identification indicia.

6. The automated process of claim 5, in which the user identification indicia on the identification section comprise numerical indicia and the sensing operation of step (e) comprises sensing such numerical indicia.

7. The automated process of claim 5, in which the user identification indicia on the identification section comprise bar code indicia, and the sensing operation of step (e) comprises sensing such bar code indicia.

8. An automated check-out process for enabling selected articles in an establishment to be purchased, said process employing storage means for holding a plurality of articles available for purchase, customer identification means including an identification section and an area containing a plurality of adhesive labels, each label containing identical identification indicia, each label being removable from the record member with the adhesive on the label enabling it to be affixed to a selected article which the customer wishes to purchase, a check-out station including scanning means, a plurality of bagging stations, scanning means associated with each bagging station for scanning labels placed on articles to be purchased, and conveyor means for transporting the selected articles comprising:

(a) providing each customer with said customer identification means;

(b) selecting articles to be purchased by a customer;

(c) placing individual labels from said area of the customer identification means by a customer on articles selected for purchase;

(d) placing selected labelled articles on the conveyor means for transportation to the checkout station;

(e) scanning all transported articles at the check-out station;

(f) verifying the validity of labels on all labelled articles at the checkout station;

(g) returning any improperly labelled articles to the storage means;

(h) determining that all selected articles have been scanned at the checkout station by scanning markings on the record member which are revealed when a label is removed, thereby ascertaining how many labels have been removed from the record member and thus how many articles have been selected by that customer;

(i) making payment by the customer at the checkout station for all selected articles scanned;

(j) collecting all of the selected articles at a predetermined one of the bagging stations by sensing the labels affixed to said selected articles; and (k) bagging the collected articles and releasing the collected articles to the customer.

9. The automated checkout process of claim 8, including the step of selecting a supermarket in which to perform steps (a) to (k).

10. The automated checkout process of claim 8, in which the identification indicia on each label comprises numerical indicia and the scanning operation of step (e) comprises scanning said numerical indicia.

11. The automated checkout process of claim 8, in which the identification indicia on each label comprise bar code indicia and the scanning operation of step (e) comprises scanning said bar code indicia.

12. The automated checkout process of claim 8, including the step of deferring release of the bagged collected articles to the customer in step (j) until it is determined that payment has been made by the customer at the checkout station.

13. The automated checkout process of claim 8, in which the identification section of the user identification means includes user identification indicia corresponding tot he user identification on the labels and the scanning operation of step (h) comprises scanning such user identification indicia.

14. The automated checkout process of claim 13, in which the user identification indicia on the identification section comprise numerical indicia and the scanning operation of step (h) comprises scanning such numerical indicia.

15. The automated checkout process of claim 13, in which the user identification indicia on the identification section comprise bar code indicia and the scanning operation of step (h) comprises scanning such bar code indicia.

16. An automated article processing system, comprising:

a plurality of storage devices for holding a plurality of articles to be processed;

a checkout station including means for sensing indicia on articles presented thereto, and means for generating data concerning all of the articles of a certain category presented thereto;

a plurality of collection stations including means for sensing indicia on articles presented thereto and collecting all of the articles of a certain category;

conveyor means for transporting selected indicia-bearing articles from the storage devices to the checkout station and from the checkout station to the collection stations; and an identification device for use in said system, said device comprising a base element having predetermined indicia thereon, having a plurality of labels attached thereto and removable therefrom for affixing to selected articles, said base element having a marking beneath each label attached thereto, said marking being sensible when the label associated therewith is removed, said labels bearing at least a portion of the predetermined indicia on the base element and also having different indicia to distinguish one label from another.

17. The system of claim 16, in which the predetermined indicia on the base element and on the labels comprise numerical indicia.

18. The system of claim 16, in which the predetermined indicia on the base element and on the labels comprise bar code indicia.

* * * * *

UNITED STATES PATENT AND TRADEMARK OFFICE

CERTIFICATE OF CORRECTION

PATENT NO. : 5,154,260

DATED : October 13, 1992

INVENTOR(S) : Ramesh U. Patel

It is certified that error appears in the above-identified patent and that said Letters Patent is hereby corrected as shown below:

Column 8, line 38, delete "tot he" and insert --to the--.

Signed and Sealed this

Second Day of November, 1993

*Attest:*

*Attesting Officer*

BRUCE LEHMAN

*Commissioner of Patents and Trademarks*